US006458029B2

(12) United States Patent
Morris

(10) Patent No.: US 6,458,029 B2
(45) **Date of Patent: *Oct. 1, 2002**

(54) RIDGE CAP VENT

(75) Inventor: Richard J. Morris, Prior Lake, MN (US)

(73) Assignee: Diversi-Plast Products, Inc., Golden Valley, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/867,950

(22) Filed: May 30, 2001

Related U.S. Application Data

(63) Continuation of application No. 09/464,923, filed on Dec. 16, 1999, now Pat. No. 6,267,668.
(60) Provisional application No. 60/112,620, filed on Dec. 17, 1998.

(51) Int. Cl.[7] ..... F24F 7/02
(52) U.S. Cl. ..... 454/365; 52/199
(58) Field of Search ..... 454/365; 52/199

(56) References Cited

U.S. PATENT DOCUMENTS

| | | | | |
|---|---|---|---|---|
| 2,200,031 A | | 5/1940 | Lee | |
| 2,214,183 A | | 9/1940 | Seymour | |
| 2,579,662 A | | 12/1951 | Gibson | |
| 2,704,500 A | | 3/1955 | Bonforte | |
| 3,079,853 A | | 3/1963 | Smith | |
| 3,185,070 A | | 5/1965 | Smith | |
| 3,236,170 A | | 2/1966 | Meyer | |
| 3,311,047 A | | 3/1967 | Smith | |
| 3,326,113 A | | 6/1967 | Smith | |
| 3,625,134 A | | 12/1971 | Smith | |
| 3,660,955 A | | 5/1972 | Simon | |
| RE27,943 E | | 3/1974 | Smith | |
| 3,949,657 A | | 4/1976 | Sells | |
| 4,280,399 A | | 7/1981 | Cunning | |
| 4,325,290 A | | 4/1982 | Wolfert | |
| 4,554,862 A | | 11/1985 | Wolfert | |
| 4,558,637 A | * | 12/1985 | Mason | 454/365 |
| 4,643,080 A | | 2/1987 | Trostle | |
| 4,762,053 A | | 8/1988 | Wolfert | |
| 4,803,813 A | | 2/1989 | Fiterman | |
| 4,843,953 A | | 7/1989 | Sells | |
| 4,876,950 A | | 10/1989 | Ruddeen | |
| 4,942,699 A | | 7/1990 | Spinelli | |
| 4,957,037 A | | 9/1990 | Tubbesing | |
| 5,002,816 A | * | 3/1991 | Hofmann et al. | 454/365 X |
| 5,022,314 A | | 6/1991 | Waggoner | |
| 5,052,286 A | | 10/1991 | Tubbesing | |
| 5,092,225 A | | 3/1992 | Sells | |
| 5,094,041 A | | 3/1992 | Kasner | |
| 5,095,810 A | | 3/1992 | Robinson | |
| 5,122,095 A | | 6/1992 | Wolfert | |

(List continued on next page.)

FOREIGN PATENT DOCUMENTS

| | | |
|---|---|---|
| GB | 2186898 | 8/1987 |

*Primary Examiner*—Harold Joyce
(74) *Attorney, Agent, or Firm*—Patterson, Thuente, Skaar & Christensen

(57) ABSTRACT

A ridge cap vent for enabling air exchange between an interior and an exterior portion of a roof and a method of installing the ridge cap vent are provided. The ridge cap vent is conformed to be disposed between an upper ridge cap member and a lower member. The ridge cap vent may be formed from a corrugated plastic material and includes a multiplicity of air passages extending generally transversely to a longitudinal axis of the ridge cap vent.

8 Claims, 4 Drawing Sheets

U.S. PATENT DOCUMENTS 5,149,301 A 9/1992 Gates
5,167,579 A 12/1992 Rotter
5,174,076 A 12/1992 Schiedegger
5,288,269 A 2/1994 Hansen
5,304,095 A * 4/1994 Morris ..... 454/365
5,326,318 A 7/1994 Rotter
5,328,407 A 7/1994 Sells
5,331,783 A 7/1994 Kasner
5,339,582 A 8/1994 Sells
5,352,154 A 10/1994 Rotter
5,425,672 A 6/1995 Rotter
5,427,571 A 6/1995 Sells
5,439,417 A 8/1995 Sells
5,542,882 A 8/1996 Sells
5,561,953 A * 10/1996 Rotter ..... 454/365 X
5,603,657 A 2/1997 Sells
5,651,734 A * 7/1997 Morris ..... 454/365
5,673,521 A 10/1997 Coulton
5,704,834 A 1/1998 Sells
5,772,502 A 6/1998 Smith
5,803,805 A 9/1998 Sells
5,830,059 A 11/1998 Sells
5,921,863 A 7/1999 Sells
5,934,995 A 8/1999 Morris
5,946,868 A 9/1999 Morris
5,947,817 A * 9/1999 Morris et al. ..... 454/365
9,015,343 * 1/2000 Castillo et al. ..... 454/365
6,039,646 A * 3/2000 Sells ..... 454/365
6,079,166 A * 6/2000 Mason et al. ..... 454/365 X

* cited by examiner

RIDGE CAP VENT

This is a Continuation of application Ser. No. 09/464,923 filed Dec. 16, 1999, U.S. Pat. No. 6,267,668 which claims the benefit of Provisional Application No. 60/112,620 filed Dec. 17, 1998.

FIELD OF THE INVENTION

The present invention relates to roof ventilating devices and, in particular, the present invention relates to roof ventilating devices made of corrugated materials used to ventilate roofs with metal ridge caps.

BACKGROUND OF THE INVENTION

Insufficient roof ventilation can result in a prolonged interface between still moist air and a colder surface. Moisture condensation on the colder surface occurs when these conditions are present. The condensed moisture often spots and damages ceilings. In more severe cases, structural members such as rafters, truss chords, joists and studs are continually damp and become unsound. Buildings with insufficiently ventilated roofs also tend to be warmer in summer months due to the presence of solar-heated air trapped within. Because of the heat retained by inadequately ventilated roofs, these buildings are more expensive to maintain at comfortable temperatures than if these roofs were adequately ventilated. However, when adequate ventilation occurs, air is kept in motion by being circulated from outside the roof, through the attic, and out through vents often placed at or near the roof ridge. Such ventilation is continually necessary in order to prevent accumulation of hot air or condensed moisture.

Various products have been developed to provide forms of ventilation. These products either provide separate ventilation structures or are themselves building materials with ventilating properties.

SUMMARY OF THE INVENTION

A vent which is disposable on a roof is provided. The vent is disposable proximate an edge of a gap formed proximate the roof peak. The vent may include one or more vent layers. Each vent layer may include a generally planar first ply and a second ply. The first and second plies are joined to define a multiplicity of air passages which enable air (or fluid) exchange between interior and exterior portions of the roof. The vent may be conformed to be disposable between an upper roof member or ridge cap and a lower roof member, the upper roof member overlaying the lower roof member when the upper roof member is in place. Exemplary second plies are convoluted or may include a multiplicity of cross-members extending between the first plies. The vent may further include means for adhering the vent to the roof when the vent is installed thereon. The adhering means may include an adhesive and the adhesive may be covered by a protective strip before the vent is installed. The vent may further include means for folding the vent. The folding means may include a flexible member hingably joining a pair of vent sections. The folding means may also include a hinge defined by an intact first ply, other first plies (if present) and the second ply being severed to further define the hinge. The folding means may be further defined by a fold extending generally transversely to a longitudinal axis of the vent. The vent may include one or more layers. If a plurality of layers are present, the layers may be fastened together in a generally stacked relationship.

There is also provided a vent operably disposable on a roof between an upper roof member and a generally planar lower roof member. The vent may include at least one generally planar first ply, at least one second ply, and means for air exchange between the interior and exterior of the roof. The air exchange means may be at least partially defined by a cooperation between the first and second plies. The air exchange means enables fluid exchange between the interior and the exterior of the roof. The vent may be conformed to be disposable between the upper roof member and the lower roof member.

There is also provided a method of installing a vent on a roof, the roof with a gap defined proximate the peak of the roof. The method may comprise the steps of providing the vent; and placing the vent along the gap. The provided vent may include a generally planar first ply and a second ply, the first and second plies joined to define a multiplicity of air passages enabling air exchange between interior and exterior portions of the roof. If more than a single vent layer is present, adjacent pairs of layers may be hingably connected. The vent may be conformed to be disposable between an upper roof member and a lower roof member underlying the upper roof member. The method may further include the step of placing the upper roof member over the placed vent. The vent may further include an adhesive on an exterior vent surface. If the vent includes the adhesive, the method may further include the step of placing the vent such that the adhesive will contact the upper roof member or the lower roof member. The vent may further include a protective member or strip disposed over the adhesive. If the vent includes a protective member or strip, the method may include the step of removing the protective member from the adhesive prior to placing the vent on the roof. The method may further include the step of disposing a closure strip between the vent and the lower roof member.

DETAILED DESCRIPTION

Figure 1:
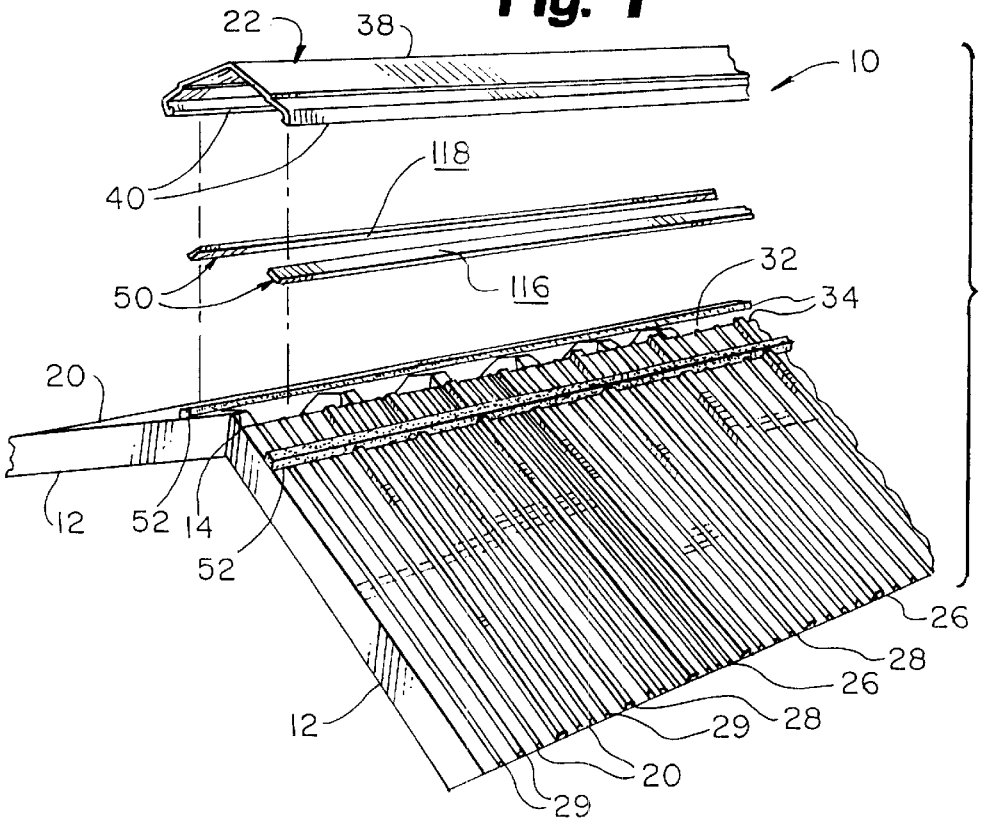
FIG. 1 is a fragmentary, exploded, perspective view of an exemplary roof including the ventilation device of this invention.

FIG. 1 depicts exemplary roof 10. The slope of exemplary roof 10 is defined by angular structural members, such as rafters 12. Opposing rafters 12 join at an angle to form peak (ridge) 14. Exterior or lower roof members of roof 10 overlaying rafters 12 include generally planar sheets 20 and an upper member, such as ridge cap 22. Each sheet 20 includes first portion 26 and a second portion, such as lateral lip 28, extending from one or both of the lateral edges of sheet 20. Lips 28 of adjacent sheets 20 overlap when sheets 20 are installed on roof 10 in this embodiment. While first portion 26 is generally planar, one or more ribs 29 may be present. Gap 32 is defined between upper edges of corresponding sheets 20 on opposing slopes of roof 10 and includes lateral edges 34. The central portion of gap 32 is coincident with peak 14 in this embodiment. Ridge cap 22 may be installed over gap 32. Ridge cap 22 may define ridge cap peak 38 and include one or more lateral lips 40. Sheets 20 and ridge cap 22 are usually fabricated from materials such as galvanized metals and synthetic resins. The galvanized metals may be prefinished. The synthetic resins may include such materials as fiberglass.

Figure 2:
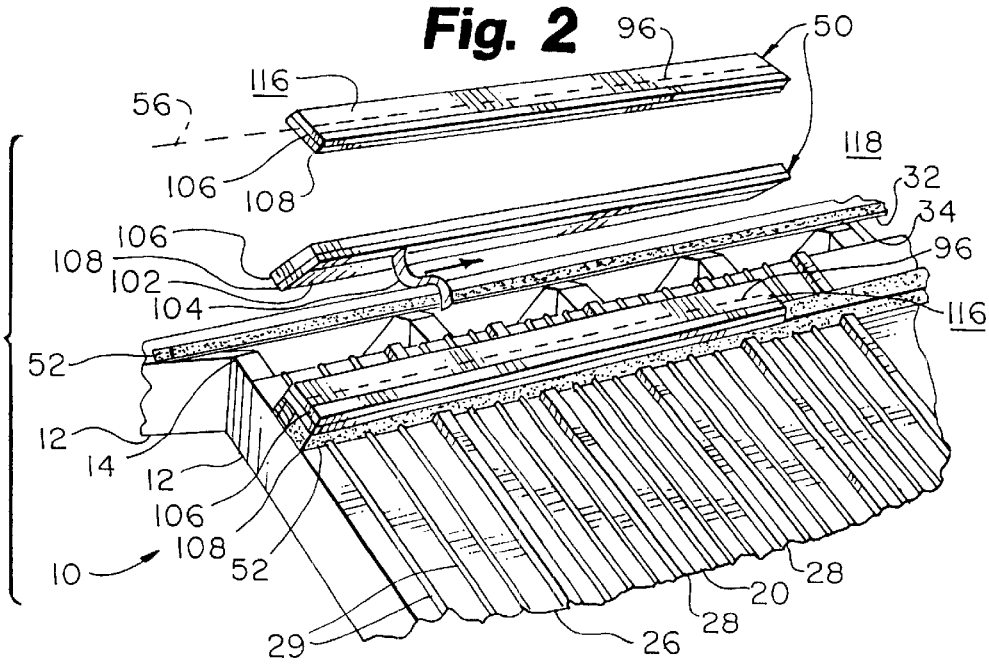
FIG. 2 is a fragmentary, exploded, perspective view of the peak portion of the roof of FIG. 1, depicting another embodiment of the ventilation device of this invention.
Figure 3:
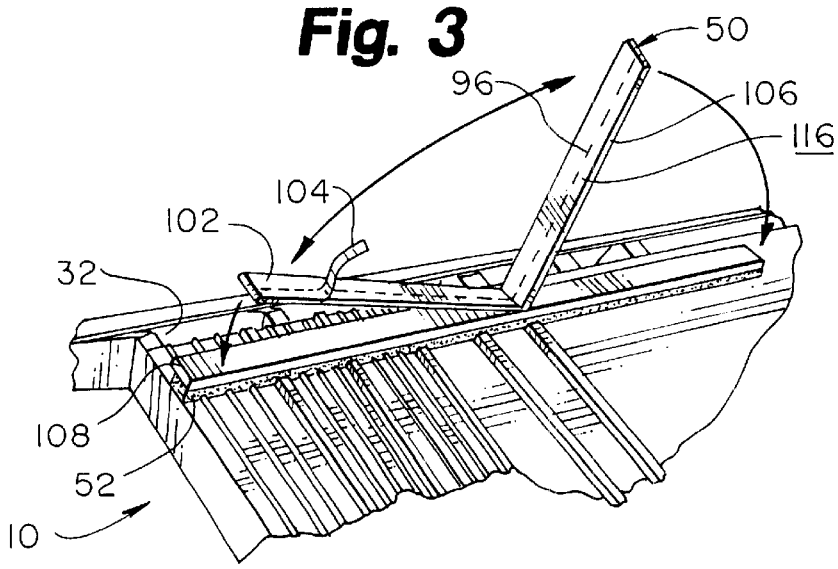
FIG. 3 is a fragmentary, perspective view of the peak portion of the roof of FIG. 1, depicting installation of the ventilation device embodiment of FIG. 2.

FIGS. 1–3 also depict exemplary ventilation devices 50 and closure strips 52. Vents 50 are advantageously disposed between installed sheets 20 and ridge cap 22 along, or proximate, edges 34. In FIG. 1, vents 50 are disposed directly beneath one or both lips 40 of ridge cap 22. A closure strip 52 may be disposed between each vent 50 and installed sheets 20. Vent 50 is more fully described below and functions to insure that air exchange proximate peak 14 between the interior and exterior of roof 10 will occur within vent 50. Closure strip 52 accomplishes this function by accommodating the nonplanar contours presented by lips 28 and ribs 29, thereby providing a substantially air-tight seal between vent 50 and sheets 20. Strip 52 may include materials such as foam rubber. Other structures equivalent to strip 52 are within the scope of this invention and include caulking, as well as other materials which may be nominally conformable to achieve a sealable interface with abutting materials having regular and irregular surface contours.

Exemplary vent 50 of this invention includes at least one layer of a corrugated material which defines air passages extending generally perpendicularly, or otherwise transversely, to longitudinal axis 56 of vent 50. The embodiment of vent 50 depicted in FIG. 2 may include at least four layers. Each layer includes a corrugated material more fully discussed below. The material included each in layer defines a multiplicity of air channels extending generally transversely to longitudinal axis 56 of ventilator 50. These air channels serve to enable air (or fluid) exchange between the interior and exterior of roof 10.

Figure 4:
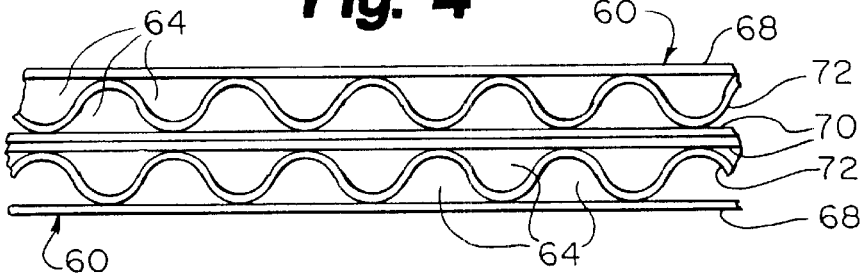
FIG. 4 is a fragmentary, cross-sectional view of two layers of a first embodiment of the corrugated material used in the ventilation device of this invention.

FIG. 4 depicts two exemplary layers of this invention, generally denoted as 60. Each exemplary layer 60 includes planar plies 68 and 70 and convoluted ply 72. Convoluted ply 72 is disposed between, and joined to (or otherwise cooperates with), planar plies 68 and 70 to define a multiplicity of air channels 64.

Figure 5:
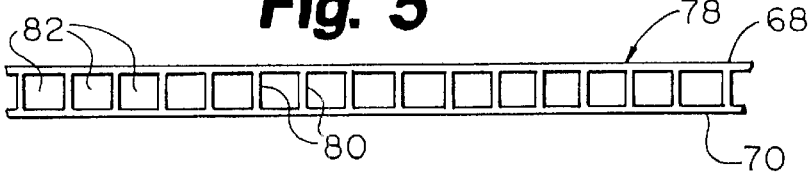
FIG. 5 is a fragmentary cross-sectional view of a single layer of a second embodiment of the corrugated material used in the ventilation device of this invention.

Referring to FIG. 5, another exemplary corrugated layer denoted as 78 includes planar plies 68 and 70, and a multiplicity of cross plies 80. Each cross ply 80 extends between planar plies 68 and 70, thereby defining a multiplicity of air channels 82 therebetween. The multiplicity of cross plies 80 is an alternate embodiment of convoluted ply 72.

Figure 6:
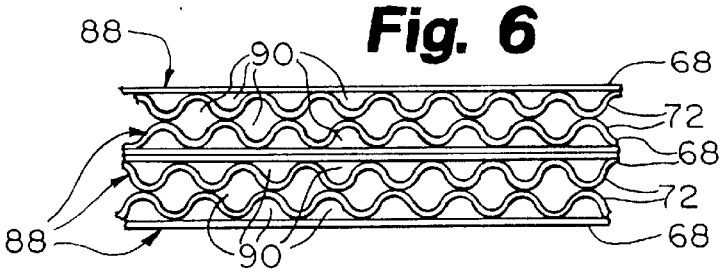
FIG. 6 is a fragmentary cross-sectional view of four layers of a third embodiment of the corrugated material used in the ventilation device of this invention.

In FIG. 6, four exemplary corrugated layers 88 are depicted. In this embodiment, each layer 88 includes planar ply 68 and convoluted ply 72. Planar ply 68 and convoluted ply 72 are joined and cooperate to define a multiplicity of air channels 90 therebetween. When layers 88 are stacked such that convoluted plies 72 abut, abutting convoluted plies 72 cooperate to define another multiplicity of air channels 90 therebetween.

Stacked exemplary layers 60, 78, and 88 may be affixed to each other by such means as stitching 96 as depicted in FIGS. 2, 3, 8*a* and 8*b*. However, layers 60, 78, and 88 may also be fastened to each other by such means as hot air welding (or other bonding means using thermal energy), ultrasonic welding, infrared bonding, staples, glue, or by other methods known to the art. In this embodiment, vent 50 comes in two four-foot strips or sections 106 and 108. Sections 106 and 108 may be joined by such means as a hinge technique (described below), folding along preformed creases, or folding over pliable hinges such as flexible (duct) tape. While one embodiment of exemplary vent 50 includes four layers such as layer 60, 78, or 90, any vent with one or more such layers is contemplated to be within the scope of this invention.

Figure 7A:
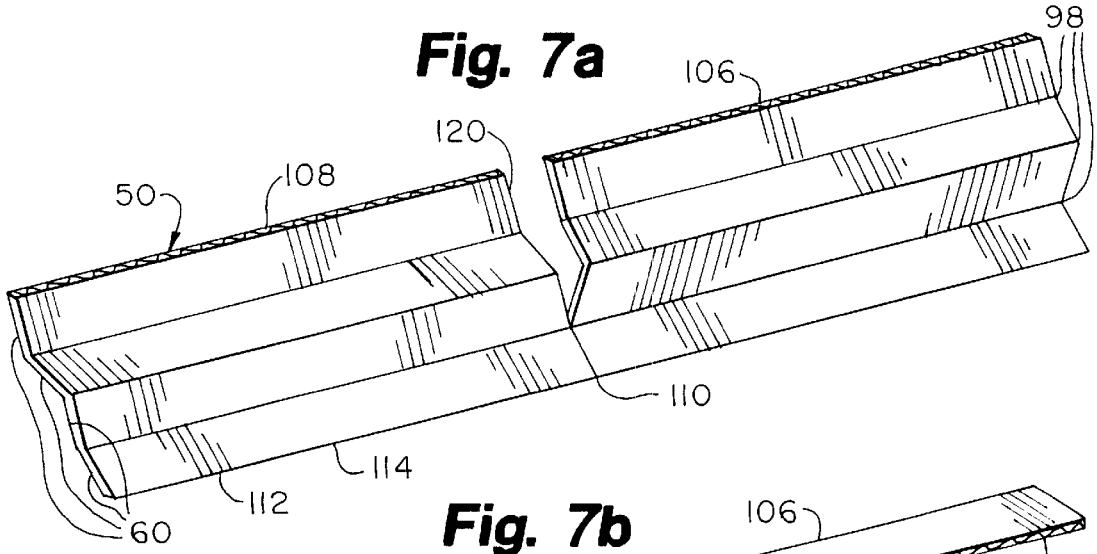
FIGS. 7*a*, 7*b*, 8*a* and 8*b* are perspective views depicting how the material of FIG. 4 is fashioned into an exemplary ventilating device of this invention.
Figure 7B:
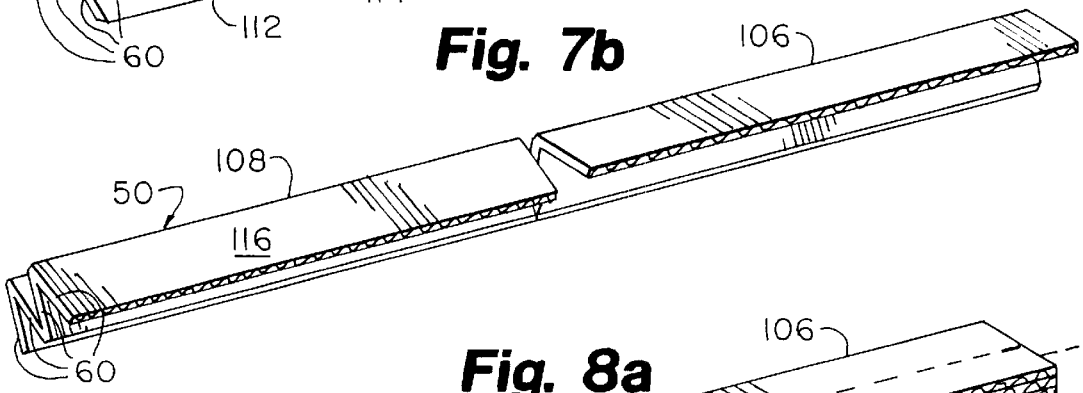

In one embodiment of the technique of defining exemplary layers 60 of this invention, layers 60 are stacked after hinge lines 98 are defined by the nick-scoring technique. The nick-scoring technique is described in U.S. Pat. No. 5,094,041, issued to Kasner et al. on Mar. 10, 1992, the entire contents of which are hereby incorporated by reference, and the teachings of which are meant to be included herein. In the nick-scoring technique, a sheet of a corrugated material, such as described above in conjunction with FIGS. 4, 5, and 6, is used. Individual hingelines 98 and individual layers 60 are defined by a series of generally linear perforations. In this embodiment, each perforation substantially extends through plies 68, 70, and 72. Substantially intact portions of plies 68, 70, and 72 remain between perforations. After these perforation lines are formed, layers 60 are accordion-folded along the hinge (perforation) lines 98 to form vent 50, as depicted in FIGS. 7*a* and 7*b*.

In another hinge-forming technique, layers such as layers 60, are stacked after hinge lines 98 are defined by the slit-scoring technique. The slit-scoring technique is described in U.S. Pat. No. 4,803,813, issued to Fiterman on Feb. 14, 1989, the entire contents of which are hereby incorporated by reference, and the teachings of which are meant to be included herein. In the slit-scoring technique, layers 60 may be defined by slitting, or slicing alternately through one of planar plies 68 or 70, and through convoluted ply 72, leaving the other planar ply 70 or 68 intact. Intact planar plies 68 and 70 enable layers 60 to be accordion-folded to form vent 50.

Figure 8A:
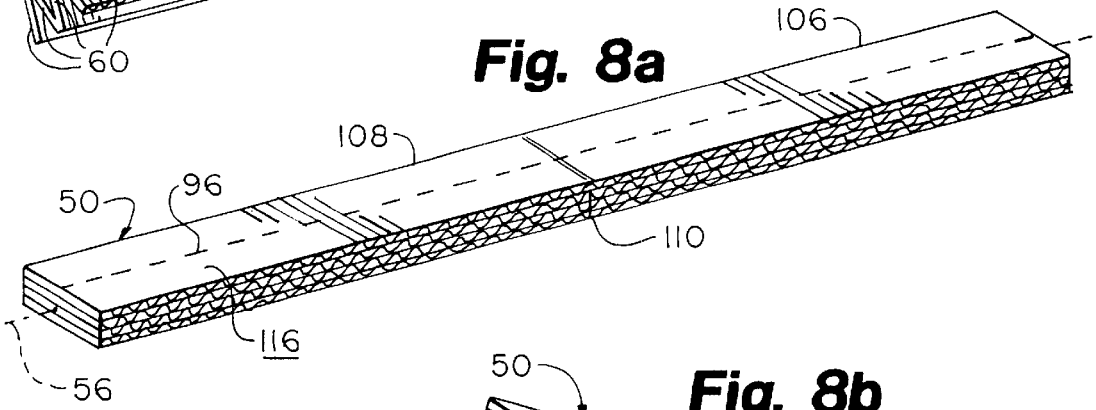
Figure 8B:
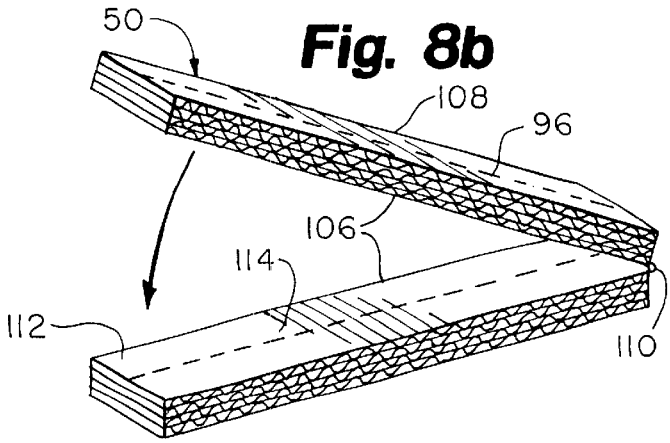
Figure 9:
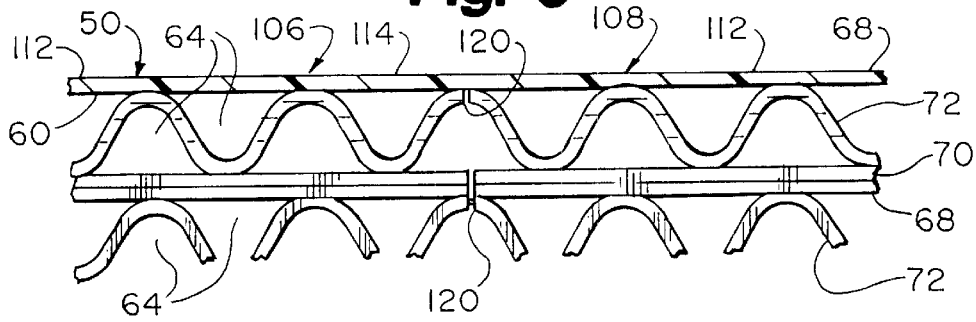
FIG. 9 is a fragmentary, cross-sectional view of one embodiment of a hinge of the ventilation device of this invention.
Figure 10:
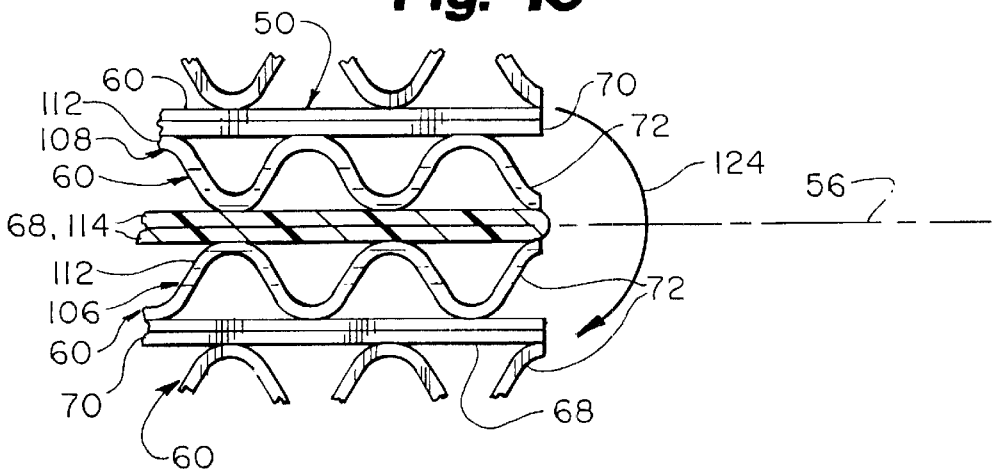
FIG. 10 is a fragmentary, cross-sectional view of the hinged ventilation device of FIG. 9 in a folded position.
Figure 11:
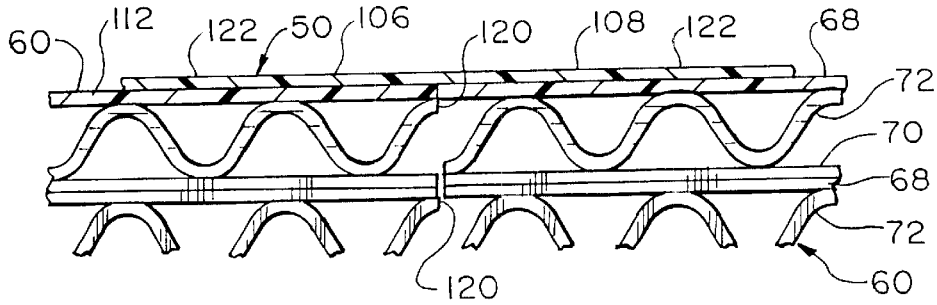
FIG. 11 is a fragmentary, cross-sectional view of another embodiment of the hinge of FIG. 9.

As depicted in FIGS. 8*a* and 8*b*, vent 50 may be further defined by the nick- or slit-scoring technique, in which sections 106 and 108 are formed so that vent 50 can be folded for reasons such as more efficient storage and transportation. In one embodiment, sections 106, 108 and hingeline 110 are formed by extending slice 120 perpendicularly, or generally transversely, to longitudinal axis 56, through all layers 60, except for a terminal layer denoted 112. In terminal layer 112, a single exterior planar ply, denoted as ply 114, is left intact. Intact ply 114 is the exterior planar ply of terminal layer 112 when vent 50 is assembled. In assembled vent 50 intact ply 114 becomes the hinge upon which sections 106 and 108 are folded along arrow 124. Alternately, an entire terminal layer 112 may be left intact to serve as a hinge, or a pliable member 122, such as flexible (duct) tape, may connect two completely separate sections 106 and 108 as shown in FIG. 11.

As depicted in FIGS. 2 and 3, one or both of upper and lower surfaces 116 and 118 of vent 50 may further include adhesive 102 to facilitate installation of vent 50 by readily mating upper and/or lower surfaces of vent 50 with either or both of ridge cap 22 and closure strip 52. A protective strip 104 may be present over adhesive 102 during storage and transportation to the installation site. Strip 104 may be peeled from adhesive 102 prior to placing vent 50 into position on roof 10. In another embodiment, vent 50 may be bonded to closure strip 52. If vent 50 and closure strip 52 are bonded together in a single piece, they may be installed in a single step rather than installing vent 50 and closure strip 52 separately.

While many materials having various specifications are suitable, exemplary layers 60 may be made of a corrugated plastic (resin) material with varying weight as may be appropriate to the use. In one embodiment, a nominal weight of between about 140 and 160 pounds per thousand square feet is useful for certain structures. The nominal weight may further be about 150 pounds per thousand square feet. The plastic resin may have a 4.0 to 4.5 millimeter profile. The plastic resin may still further include a profile of about 4.0 (±0.2) millimeters. The plastic material may be black and may include ultraviolet (UV) inhibitors to enable the plastic resin to better withstand extended exposure to UV light. The vent of this invention may include a high-density polyethylene, corrugated resin with a brittleness temperature of about −103° (±50) F., a deflection temperature of about +162° (±50) F. at 66 (±5) pounds per square inch, a burn rate of about 2.5 (±0.5) inches per minute, and a self-ignition temperature of about 734° (±500) F., and may also merit a label of "excellence" for smoke density of a 9.3 percent average.

Exemplary vent 50 may be about ⅝ (±) inches in thickness, three (±0.5) inches in width, and include two sections 106 and 108, each section 106 and 108 being about 48 (±0.5) inches in length. However, other dimensions are contemplated to be within the scope of this invention according to the structure environment, and materials selected for use. Because numerous modifications may be made of this invention without departing from the spirit thereof, the scope of the invention is not to be limited to the embodiments illustrated and described. Rather, the scope of the invention is to be determined by appended claims and their equivalents.

What is claimed is:

1. A vent system disposable underlying a ridge cap and on a roof proximate an edge of a gap, the gap defined proximate a roof apex, the vent system comprising:

at least a first vent, the vent being conformed to be disposed beneath a ridge cap lip and comprising a plurality of hingably connected vent layers, each vent layer comprising generally planar first ply;

an opposed second ply, the first and second plies joined to define a multiplicity of air passages enabling air exchange between interior and exterior portions of the roof;

an adhesive material disposed on the exterior margins of the first ply, the adhesive being exposable to structurally and sealingly adhere the vent system to the roof; and at least a first closure strip disposable between the first vent and a lower roof member, the roof member having nonplanar contours, the closure strip having a strip thickness sufficient for the strip to sealingly accommodate both the lower roof member nonplanar contours and the vent generally planar first ply.

2. The vent of claim 1, in which a pair of first plies are present.

3. The vent of claim 2, in which the second ply is convoluted.

4. The vent of claim 3, in which the second ply comprises a multiplicity of cross members extending between the first plies.

5. The vent of claim 2, in which the second ply is disposed between said pair of first plies.

6. The vent of claim 2, further including a first hinge defined by the second ply and one the first plies being severed generally parallel to a vent longitudinal axis.

7. The vent of claim 2, in which a first hinge is defined by a generally linear series of alternate intact and severed portions extending generally parallel to a vent longitudinal axis, said intact portions including generally intact first and second plies and said severed portions including generally severed first and second plies.

8. The vent of claim 7, further comprising a plurality of sections separated by a second hinge, the second hinge extending generally transversely to a vent longitudinal axis.

* * * * *

UNITED STATES PATENT AND TRADEMARK OFFICE

CERTIFICATE OF CORRECTION

PATENT NO. : 6,458,029 B2
DATED : October 1, 2002
INVENTOR(S) : Morris

It is certified that error appears in the above-identified patent and that said Letters Patent is hereby corrected as shown below:

Column 3,
Line 44, delete “each in” and insert -- in each --.

Column 5,
Line 35, “(±)” and insert --(± $\frac{1}{8}$)--.

Column 6,
Line 8, after “comprising” insert -- -- --
Line 9, before “generally” insert -- a --.
Line 34, after “one” insert -- of --.

Signed and Sealed this

Eighteenth Day of March, 2003

JAMES E. ROGAN
*Director of the United States Patent and Trademark Office*